US006744899B1

(12) United States Patent
Grunberg

(10) Patent No.: US 6,744,899 B1
(45) Date of Patent: Jun. 1, 2004

(54) DIRECT COUPLING OF WAVEGUIDE TO COMPRESSION DRIVER HAVING MATCHING SLOT SHAPED THROATS

(76) Inventor: Robert M. Grunberg, 4 Herbert Road, Edgecliff, NSW (AU), 2027

( * ) Notice: Subject to any disclaimer, the term of this patent is extended or adjusted under 35 U.S.C. 154(b) by 0 days.

(21) Appl. No.: 09/668,002

(22) Filed: Sep. 21, 2000

Related U.S. Application Data

(63) Continuation-in-part of application No. 08/956,964, filed on Oct. 23, 1997, now abandoned, which is a continuation-in-part of application No. 08/652,665, filed on May 28, 1996, now abandoned.

(51) Int. Cl.[7] ..... H04R 25/00
(52) U.S. Cl. ..... 381/343; 381/340
(58) Field of Search ..... 381/340, 341, 381/342, 343, FOR 143, 339; 181/152, 159, 177, 185, 192, 175

(56) References Cited

U.S. PATENT DOCUMENTS

| | | | | | |
|---|---|---|---|---|---|
| 4,143,738 | A | * | 3/1979 | Nakazono et al. | 381/340 |
| 4,776,428 | A | * | 10/1988 | Belisle | 181/152 |
| 5,004,067 | A | * | 4/1991 | Patronis | 381/340 |
| 5,117,462 | A | * | 5/1992 | Bie | 381/343 |
| 5,933,508 | A | * | 8/1999 | Fuke et al. | 381/343 |

* cited by examiner

*Primary Examiner*—Huyen Le
(74) *Attorney, Agent, or Firm*—Myers Dawes Andras & Sherman LLP; Joseph C. Andras

(57) ABSTRACT

There is disclosed an acoustic driver having a phasing and compression plug and its direct coupling to an acoustic waveguide having an entry throat with a non-unity aspect ratio, such as a rectangular diffraction slot. The phasing and compression plug has an input end with an input surface having a plurality of input apertures configured in a parallel array of spaced-apart chordal slits. The opposite, output end of the plug has a like plurality of output apertures contained in an output region having unequal length and width dimensions such that the area of the output region is less than that of the input surface. A plurality of passages through the plug body connect each respective input aperture to the corresponding output aperture wherein the relative lengths of the passages are preselected to provide an acoustic wavefront which is concave at its major (vertical) axis and planar or convex across its minor (horizontal) axis. The phasing and compression plug of the invention affects the transition of the bounds of the wavefront from round to a shape having a non-unity aspect ratio such that the throat of the driver can be directly coupled to an acoustic waveguide having a throat with a matching non-unity aspect ratio shape, thereby eliminating the requirement for a round-to-rectangular transition coupler and also for a waveguide or horn with an internal diffraction slot. Consequently, the above factors contribute to enable a cylindrically expanding wavefront to be accurately propagated out of one of and thus out of an array of waveguide mouths.

31 Claims, 6 Drawing Sheets

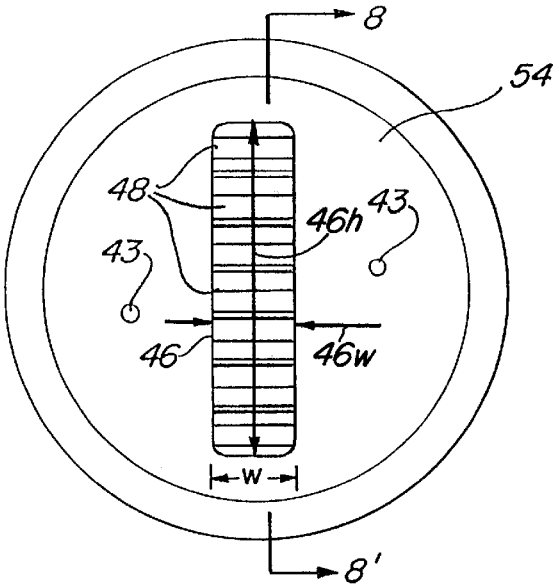
FIG. 6
FIG. 8
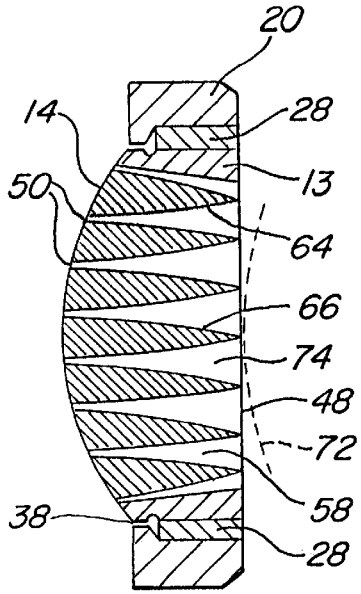
FIG. 7
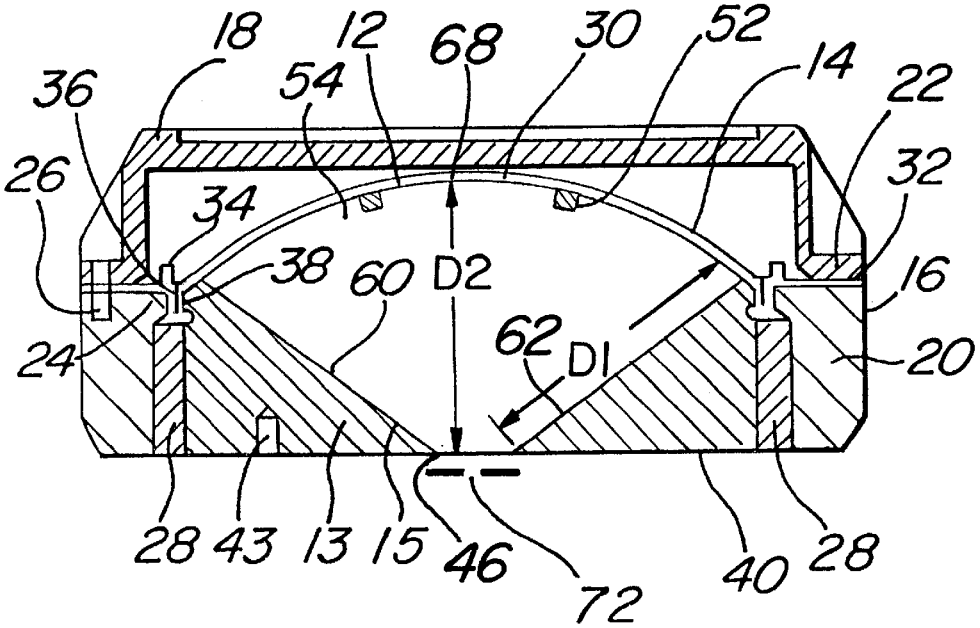

FIG. 9
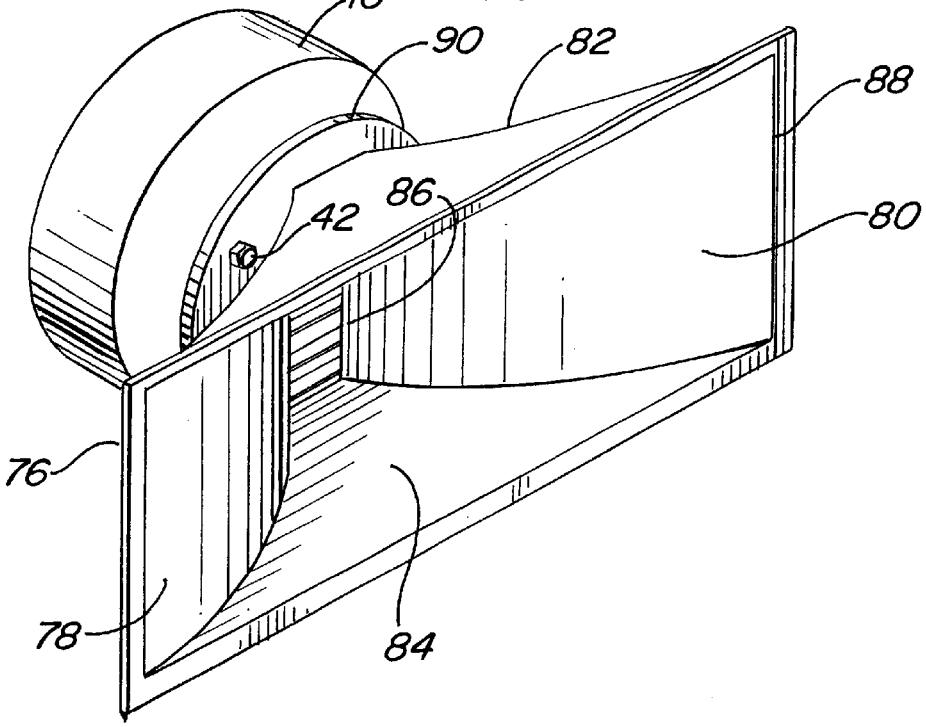
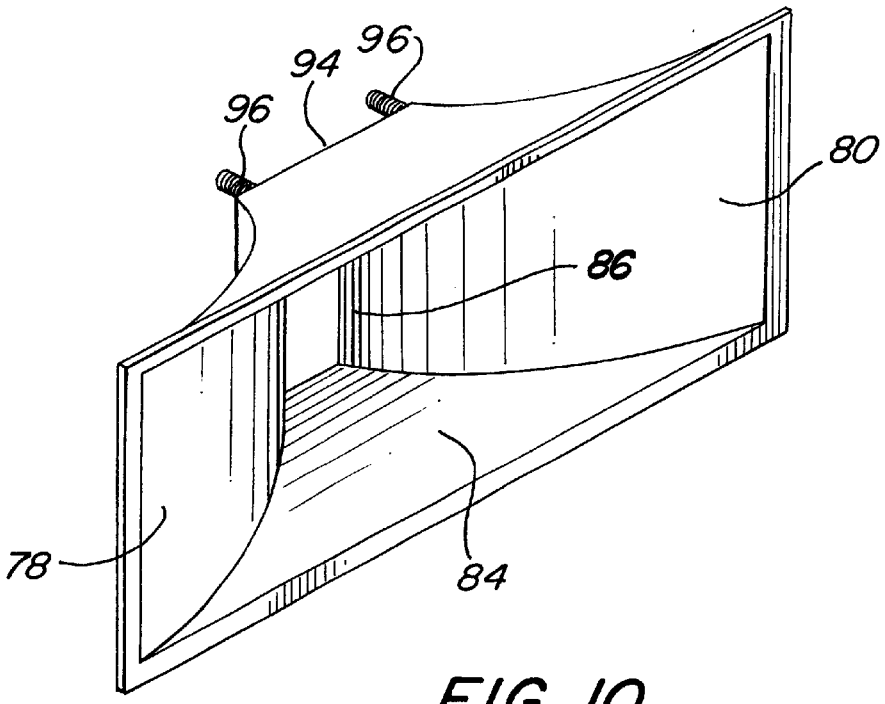
FIG. 10

DIRECT COUPLING OF WAVEGUIDE TO COMPRESSION DRIVER HAVING MATCHING SLOT SHAPED THROATS

REFERENCE TO RELATED APPLICATIONS

This application is a continuation-in-part of my prior application, Ser. No. 08/956,964, filed Oct. 23, 1997, abandoned, which application is a continuation-in-part of my prior application, Ser. No. 08/652,665, filed May 8, 1996, now abandoned.

BACKGROUND

1. Field of Invention

This invention relates to electro-acoustic transducers and specifically to the type commonly referred to as compression drivers which are used in conjunction with acoustic horns, waveguides or directional baffles.

2. Brief Statement of the Prior Art

Compression drivers have traditionally been equipped with diaphragms having a spherical section radiating surface of area $A_{in}$, which conforms to a spherical input surface of a phasing/compression plug (acoustic transformer or equalizer). The acoustic pressure generated by movement of the diaphragm is directed into inlet apertures, in the form of slits or holes, on the spherical input surface of the compression plug through a plurality of passages that pass through the body of the compression plug to emerge from outlet ports which are collectively contained in a circular output region, called the throat of area $A_{out}$, on the front of the driver disposed towards the horn where $A_{out}$ is less than $A_{in}$.

FIGS. 1 to 3 show various prior art compression plugs 250*a*, 250*b*, 250*c* used in conventional round throated compression drivers (not shown). As shown, the input apertures typically consist of distributed holes, concentric slits, radial slits and combinations thereof. The compression plug causes the air displaced by the diaphragm to be compressed and to emerge in planar phased coherence at the circular throat of the driver. FIG. 1 shows input apertures provided as concentric slits; FIG. 2 shows input apertures provided as radial slits; and FIG. 3 shows input apertures provided as distributed holes. In each figure, a dashed circle 251 represents the location of the compression driver's round throat on the far side of the illustrated compression plugs.

Compression plugs for high frequency drivers have been designed with a chosen compression ratio, typically about 10:1, and with the distances between the inlet apertures being sufficiently small to enable a unique phase relationship up to the highest desired frequency which forms a plane wave at the circular throat on the front of the driver. This originated because the 1919 paper by A. G. Webster on the mathematical modeling of the acoustic characteristerics of horns with various flare equations was based on zero curvature assumptions. Thus, the predominant model of the day had generated a plane wave at the throat of the compression driver, which coupled to a acoustic horn, having a round input throat of equal diameter and in this model, the plane wave at the throat of the driver propagates through the horn and exits at the horn mouth, impossibly, as a non-divergent plane wave.

Acoustic horns and waveguides having non-circular throats with unequal height to width dimensions (non-unity aspect ratios), usually rectangular, are well known. As shown in FIG. 4, for example, multicell horns 200 generally have a rectangular throat 201 requiring that an intermediate acoustic coupler 210 that provides a round to square, or round to rectangular (unity to non-unity) transition from the circular throat of the compression driver (not shown) to the rectangular input throat 201 of the horn.

In attempts to avoid horizontal beaming of the acoustic output at the higher frequencies of the driver's operating range, the horn's rectangular input throat has evolved into a diffraction slot. As used herein, therefore, a diffraction slot is defined as an acoustically diffractive aperture with a non-unity aspect (height/width) ratio. The diffraction slot is typically, but not necessarily rectangular and according to this present specification, is necessarily of lesser area than that of the radiating diaphragm.

OBJECTIVES OF THE INVENTION

The objectives of this invention are to provide:

1) A large scale, high acoustic output, multi element, sectoral line array with coupled horizontal waveguide which, acoustically, radiates a wavefront at the mouth of the waveguide as would a ribbon radiator with a coupled waveguide; ie, having a straight isophase line; ie, having a cylindrical wavefront.
2) A compression driver and waveguide to satisfy the elemental requirements so that a cylindrical array of waveguide mouths collectively propagate sound energy so as to disobey the inverse square law by the closest approach to the theoretically attainable 3 dB between spherical and cylindrical radiation.
3) A compression driver with a slot throat which generates a concave isophase line along the major axis of the slot to propagate through the waveguide and emerge at its mouth straight.
4) Thus a phasing plug that results in a concave isophase line along the major axis of its output end, and straight or slightly convex across the diffracting minor axis.
5) A phasing plug of which the spherical input surface has apertures in the form of chordal slits in parallel array.
6) A compression driver which has a throat that is a slot.
7) compression drivers which may be directly coupled to an acoustic horn or waveguide having a diffraction slot at its throat.
8) Waveguides with a diffraction slot throat that requires no intermediate acoustic coupler for driver mounting, and no requirement for an internal diffraction slot in the waveguide.
9) High output, cylindrical radiator loudspeaker systems which are comprised of arrays of mouths of coupled waveguides and drivers in accordance with the above.
10) Large area, high output, plane radiator loudspeaker systems to most closely approach disobeyance of the inverse square law by the theoretically available 6 dB.
11) Arrayed loudspeaker systems projecting sound energy with maximum integrity, ie, minimum acoustic phase cancellations; loudest and clearest.
12) Arrayed loudspeaker systems whereby far field radiation conditions are approached at the mouth of each elemental waveguide and driver.
13) Arrayed loudspeaker systems with appropriate interface and control and signal processing for variable positioning of lobes.

Other and related objectives will be apparent from the following description of the invention.

SUMMARY OF THE INVENTION

This invention relates generally to a phasing/compression plug and the direct coupling of its acoustic output to a waveguide or horn having a slot throat. The plug has an input or primary end having a surface conforming to the contour of the radiating diaphragm and spaced therefrom and having a plurality of inlet apertures, preferably slits, in parallel array at spaced-apart increments, and it has a like plurality of output apertures in parallel and juxtaposed array on the secondary end of the plug body, which collectively form an output aperture within a region which has unequal length and width dimensions and which is of lesser area than the area of the input surface. A plurality of passages through the plug body connect each of the primary surface input apertures to a respective output aperture. The relative lengths of the passages are preselected to provide an acoustic wavefront which may be concave along its major (vertical) axis to achieve narrow vertical dispersion, and planar or convex across its minor (horizontal) axis to accomplish wide horizontal dispersion by diffraction.

The phasing/compression plug of the invention effects the transition of the bounds of the wavefront from round to a non-unity aspect ratio in a novel function of the plug such that the throat of the driver can be directly coupled to an acoustic waveguide or horn having a matching slot throat, thereby eliminating the requirement for a transition coupler and for a horn with an internal diffraction slot.

In a first aspect, the invention may be regarded as a phasing and compression plug for use in or with an electro-acoustic transducer, the plug comprising: a body with an input end having an input surface of area $A_{in}$ and an output end having an output region of area $A_{out}$ where $A_{in}>A_{out}$; a plurality of input apertures provided as chordal slits that are arranged in a substantially parallel, spaced-apart configuration on the input surface at the input end of the body; a corresponding plurality of output apertures contained in the output region at the output end of the body; and a plurality of passages through the body, each passage connecting one the plurality of input apertures with a corresponding output apertures, and expanding in area from the input apertures to the output apertures.

In a second aspect, the invention may be regarded as a phasing and compression plug for use in or with an electro-acoustic transducer, the plug comprising: a body with an input end having an input surface of area $A_{in}$ and an output end having an output region of area $A_{out}$ where $A_{in}>A_{out}$ the output region having an non-unity aspect ratio; a plurality of input apertures on the input surface at the input end of the body: a corresponding plurality of output apertures contained in the output region at the output end of the body; a plurality of passages through the body, each passage connecting each of the plurality of input apertures with a corresponding output aperture, and expanding in area from the input apertures to the output apertures.

In a third aspect, the invention may be regarded as a phasing and compression plug for use in an electro-acoustic transducer having a diaphragm with a circular, contoured, vibrating surface, the plug having: an input end with an input surface of area $A_{in}$ that conforms to the contour of said vibrating surface; an output end with a output region of area $A_{out}$ where $A_{in}>A_{out}$, the output region having an non-unity aspect ratio with a major axis and a minor axis; a plurality of input apertures provided as chordal slits that are arranged in a substantially parallel, spaced-apart configuration on the input surface of said input end; a corresponding plurality of output apertures collectively contained in the output region at the output end of said plug; and a plurality of passages, one each extending from each of said input apertures on said input surface to a respective outlet aperture and expanding in area in the direction towards said outlet apertures.

In a fourth aspect, the invention may be regarded as a compression driver having a phasing and compression plug with a plurality of input apertures at an input end having an input surface of area $A_{in}$ and with multiple passages leading to multiple output apertures at an output end and within an output region of non-unity aspect ratio and of area $A_{out}$ where $A_{in}>A_{out}$, the compression driver having a throat continuing from the output region of the phasing and compression plug, and including means to mount said compression driver to a waveguide having a matching throat.

BRIEF DESCRIPTION OF THE DRAWINGS

FIG. 6 is a view of the opposite throat end of the driver and the output region of the phasing/compression plug shown in FIG. 5 being visible in the center;

FIG. 7 is a sectional view along line 7—7 of FIG. 5;

FIG. 8 is a sectional view along line 8—8 of FIG. 6;

FIG. 9 is a perspective view of the compression driver 10 of the invention coupled to a mounting flange of an acoustic horn;

FIG. 10 is a perspective view of an alternative acoustic horn having mounting studs to couple to the compression driver;

DETAILED DESCRIPTION OF THE PREFERRED EMBODIMENTS

Figure 1:
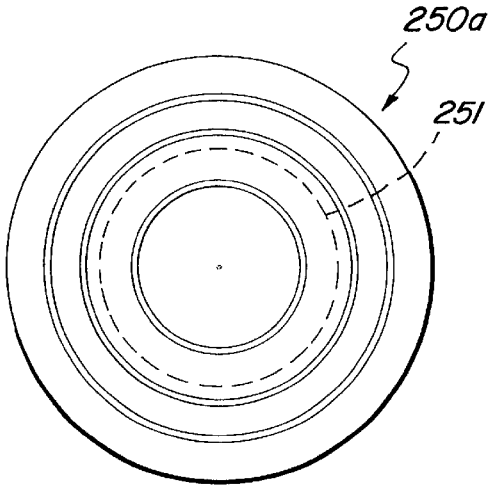
FIG. 1 PRIOR ART
FIG. 1 is a view of the spherical input surface at the diaphragm end of a prior art compression plug where in the inlet apertures are provided as concentric slits.
Figure 3:
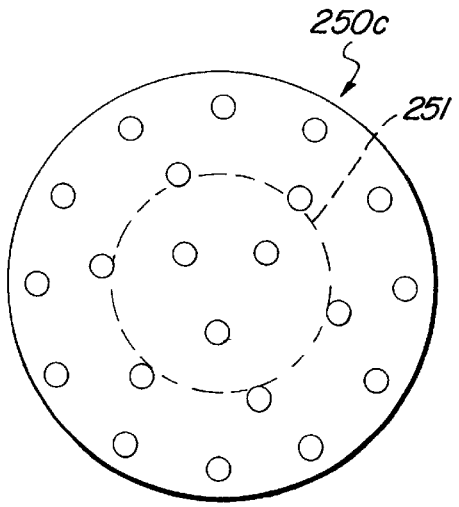
FIG. 3 PRIOR ART
FIG. 3 is a view of the spherical input surface at the diaphragm end of a prior art compression plug wherein the inlet apertures are provided as distributed holes.
Figure 2:
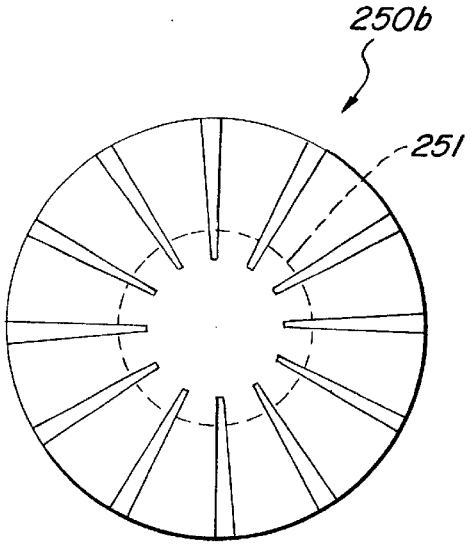
FIG. 2 PRIOR ART
FIG. 2 is a view of the spherical input surface at the diaphragm end of a prior art compression driver where the inlet apertures are provided as radial slits.

FIGS. 5–8 and 15 show a first preferred compression driver 10 containing a first preferred phasing/compression plug 14 (generally hereafter just "plug" for the sake of brevity).

As shown, this particular compression driver 10 is formed from the plug 14 in combination with a diaphragm 30 with an integral voice coil 36 a circular array of permanent magnets 28 and associated pole pieces 13, 20 and a cover 18.

As further shown in the figures, the plug 14 generally comprises a body (not numbered) with an input end 12 and an output end 46. The input end may be regarded as an input surface 12 of area $A_{in}$, and the output end 46 may be regarded as an output region 46 of lesser area $A_{out}$.

Figure 5:
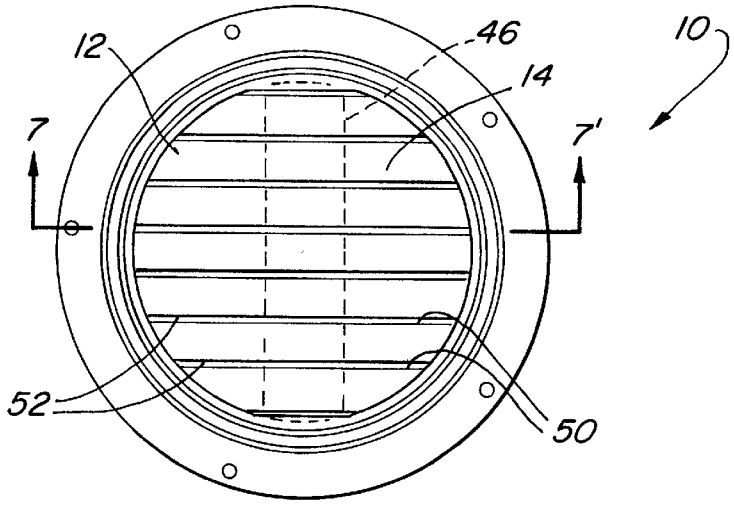
FIG. 5 is a plan view of the spherical input surface at the diaphragm end of a first compression driver (with cover and diaphragm removed for clarity) having a first preferred phasing/compression plug. The spherical input surface at the diaphragm end of the phasing/compression plug is visible in the center.

FIG. 5 shows the back of the compression driver 10 without its cover 18 or diaphragm 30 in order to expose the input surface 12 of the plug 14.

FIG. 6 shows the front 54 of the compression driver 10 that contains a throat (not separately numbered) formed, in part, from the output region 46 of the plug 14.

As best shown in FIG. 7, the cover 18 and an outer pole piece 20 are combined to form a cylindrical housing 16. In particular, the cover 18 has a flange 22 which is secured to the outer pole piece 20 with assembly screws (not shown) which are received in threaded bores 26 in the outer pole piece 20. The outer pole piece 20 supports the circular array of permanent magnets 28 which surround the inner pole piece 13.

The plug 14 is received in an arcuately tapered recess 15 in the inner pole piece 13, its input surface 12 conforming to an inward surface of the diaphragm 30. Here, the diaphragm 30 and the input surface 12 have spherical surfaces, but other geometries are possible.

The diaphragm 30 has an annular rim 32 that is received between the flange 22 of the cover 18 and outer pole piece 20. The diaphragm 30, in practice, is formed of metal foil or a fiber composite with a thickness from about 0.002 for high frequency drivers to about 0.02 inch for middle frequency drivers.

The annular rim 32 of the diaphragm 30 has an annular compliance section 34 and a cylindrical voice coil 36 that extends from the diaphragm 30 adjacent to the compliance 34. The voice coil 36 extends into an annular air gap 38 between the inner pole piece 13 and the outer pole piece 20 such that currents driven through the voice coil 36 will cause the diaphragm 30 to move accordingly.

In this embodiment, the inner pole piece 13 provides a planar surface 40 on which to mount a horn flange.

FIG. 7 is a sectional view of the compression driver 10 along the section line 7—7 of FIG. 5. Here, the cover 18 and the diaphragm 30 are depicted and the spherical nature of the diaphragm 30 and the plug's input surface 12 is visible.

The internal topology of the plug 14 is best understood through simultaneous reference to FIGS. 5–8 and 15. The figures collectively show a plurality of input apertures 50 on the plug's spherical input surface 12, the input apertures 50 opening to a corresponding plurality of passages 58 that expand to the plug's output region 46.

The preferred input apertures 50 are provided as closely-spaced, parallel array of chordal slits 50. Above a frequency related to the diameter and material of the diaphragm, pistonic behaviour ceases and the surface area of a circular diaphragm tends to breakup in radial and concentric modes of resonance. The parallel, chordal slits beneficially randomize the resonant acoustic output from the modal vibration of the diaphragm, resulting in smoother response in the resonant frequency range.

Figure 5A:
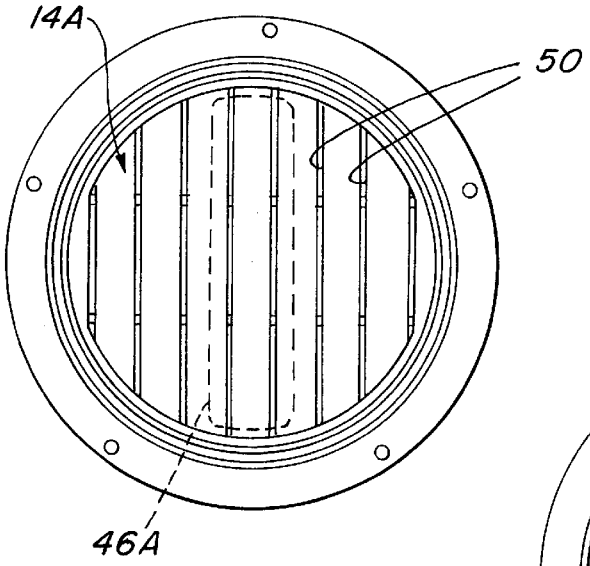
FIG. 5A is a plan view of the spherical input surface at the diaphragm end of a first alternative compression driver that uses a plug 14A having parallel chordal slits 50 where the compression driver's rectangular throat 351 is oriented in parallel with the slits.
Figure 5B:
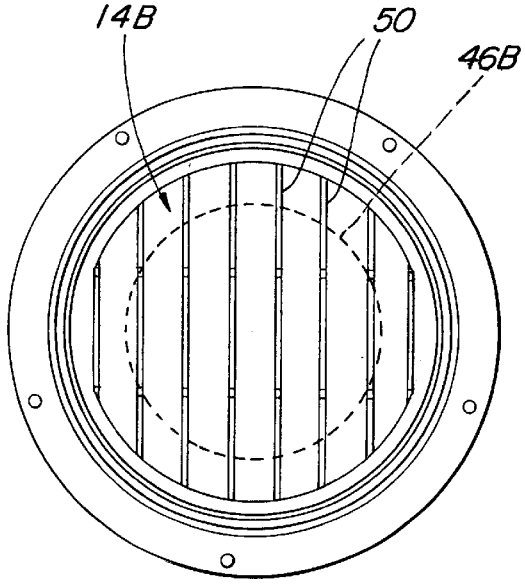
FIG. 5B is a plan view of the spherical input surface at the diaphragm end of a second alternative compression driver that uses a plug 14B having parallel chordal slits 50 where the compression driver has a circular throat 46B.

As shown in FIG. 5A and 5B, several other plug configurations with parallel chordal slits are possible. In FIG. 5A, for example, the parallel chordal slits 50 are used in a plug suitable for use in a compression driver having a rectangular throat 46A that is oriented in parallel with the slits rather than perpendicularly as shown in FIG. 5. In FIG. 5B, the parallel chordal slits 50 are used in a plug suitable for use in a compression driver having a circular throat 46B.

Returning to the embodiment of FIGS. 5–8, the passages 58 that connect the input apertures 50 to corresponding output apertures 48 are best understood with reference to FIGS. 7 and 8. As shown in FIG. 7, each passage 58 has converging side walls 60 and 62 and, as shown in FIG. 8, each passage 58 has diverging top and bottom walls 64 and 66. In the direction of propagation, therefore, the passages 58 converge toward the output region 46 along one axis (see FIG. 7) while expanding, overall, in terms of cross-sectional area from input aperture 50 to output aperture 48.

FIG. 5 shows the input apertures 50 in perpendicular alignment with the output region 46 (dashed line). In the perpendicular case, the output apertures contained in the output region are of lesser width and greater height than said slits. Other orientations are possible. The input apertures 50, for example, could also have a parallel orientation relative to the output region 46A as shown in FIG. 5A. In the parallel case, the output apertures contained in the output region are of greater width and lesser height than longest of said slits.

The passages 58 are contoured and dimensioned as necessary for the desired performance of the compression driver 10 and associated waveguide or horn.

In the preferred plug 14, the ratio of the area of each input aperture 50 to the area of its respective output aperture 48 is preferably a constant value to provide the same expansion rate through each passage 58.

As shown in FIG. 7, the length "$D_1$" of the side walls 60, 62 is preferably equal to or less than the axial distance "$D_2$" from an apex 68 of the input surface 12 to a corresponding point in the output region 46. This dimensional parameter adjusts a wavefront 72 that is flat, or slightly convex across the minor axis of the output region 46.

As shown in FIG. 8, the distances through the passages 58 in the direction of propagation are preferably unequal, with the distance through a centermost passage 74 being greater than that through a laterally located passage 58. The spatial relationship with the spherical diaphragm generates a concave wavefront 72 along the major axis of the output region 46.

The plug's passages 58 are preferably dimensioned, therefore, to generate a wavefront 72 that is concave over the major axis and straight or convex over the minor axis of the output region 46. A concave wavefront 72 over the major axis of the driver's output region 46 is desirable in terms of its propagation characteristics when the driver 10 is attached to a suitably dimensioned horn having appropriately divergent top and bottom walls. In particular, the concave wavefront 72 will propagate through such a horn and exit the horn's mouth as a substantially straight wavefront along the vertical axis. The result is a cylindrically expanding wavefront emanating from the mouth of the horn, a wavefront that provides higher vertical directivity than possible with a conventional round throated driver coupled to an equivalently dimensioned horn. The prior art combination undesirably forms a deformed convex spherical wavefront at the horn's mouth, a convex wavefront is inherently divergent.

The preferred plug 14 has bridging ribs 52 within the input apertures 50 so that they are integral with the plug 14 thereby permitting the plug 14 to be fabricated and placed in the assembly as a unitary body.

The throat of the driver must ultimately couple to the throat of the horn. Drivers have traditionally been provided with round throats and such drivers directly couple to a horn with a round throat (that may or may not have transitioned to another internal profile), or indirectly to a horn with a rectangular throat by the use of a transition coupler or throat adapter having a round-to-rectangular configuration.

FIG. 6 shows the output region 46 containing outlet apertures 48 on the front 54 of the compression driver 10. The preferred output region 46 has a greater height (h) than width (w) such that it has a major axis 46*h* and a minor axis 46*w*. Stated another way, the output region 46 has a non-unity aspect ratio in contrast to circular or square output region of known types that have an aspect ratio of unity.

The minor axis of the output region 46 is preferably no greater than 33 percent of the diameter of the circular vibrating surface of the diaphragm 30, most preferably 25 percent for a high frequency compression driver. The major axis of the output region 46 is preferably no less than 75 percent of the diameter of the vibrating surface of the diaphragm 30.

FIG. 6 shows an output region 46 having a rectangular shape for coupling directly to a matching slot throated horn. This aspect of the invention, however, is satisfied by any output region having a non-unity aspect ratio such as an ellipse, an elongated polygon, or any other elongated shape.

FIG. 9 shows the first preferred compression driver 10 that is coupled directly to an acoustic horn 76 having widely diverging sidewalls 78 and 80 and slightly diverging top and bottom walls 82 and 84. As typical of modern horns, the horn 76 has a rectangular throat 86 that expands to a rectangular mouth 88. Though rectangular, the horn 76 has a circular mounting flange 90 for attachment to the front 54 of the compression driver 10. In FIG. 9, the horn 76 is attached to the driver's front 54 with screws 42 that engage corresponding screw holes 43 in the planar surface 40 of the inner pole piece 13. (shown in FIG. 7).

Figure 4:
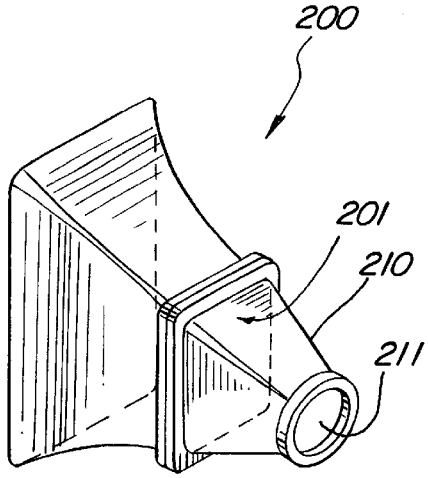
FIG. 4 PRIOR ART
FIG. 4 is a perspective view of a prior art acoustic horn 200 having a rectangular throat 201 and a transition coupler 210 having a round throat 211 on which to mount a conventional round throated compression driver (not shown) to the horn 200.

When the driver 10 is mounted to the horn 76, the driver's slot throat (defined mainly by the output region 46 of the plug 14) is aligned with and acoustically coupled directly to the horn's slot throat 86. It is now possible, therefore, to couple the driver 10 directly to a horn having a rectangular throat 86 that is sufficiently narrow as to function as a diffraction slot. There is beneficially no need to provide a separate transition coupler as shown in FIG. 4, or to provide an internal round-to-rectangular transition within the horn.

FIG. 10 shows an alternative horn having an external mounting surface 94 that surrounding the throat 86 and supports a plurality of threaded posts 96 that engage holes in a suitable mounting bracket that is attached to or integrally formed with the driver 10. The number of posts 96 may vary, but there are preferably four.

Figure 11:
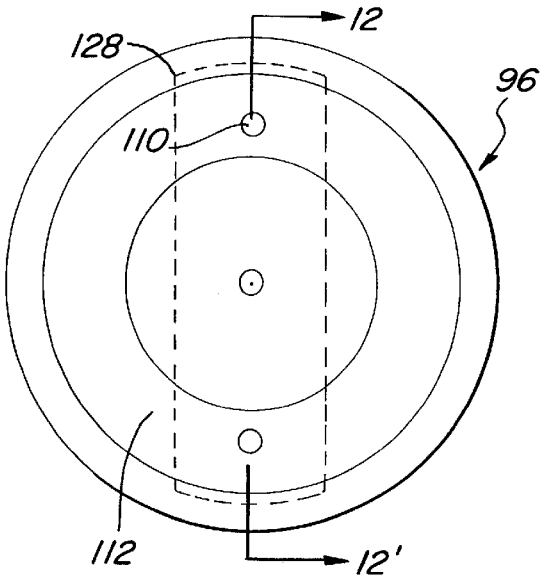
FIG. 11 is a plan view of the rear end of a second compression driver
Figure 12:
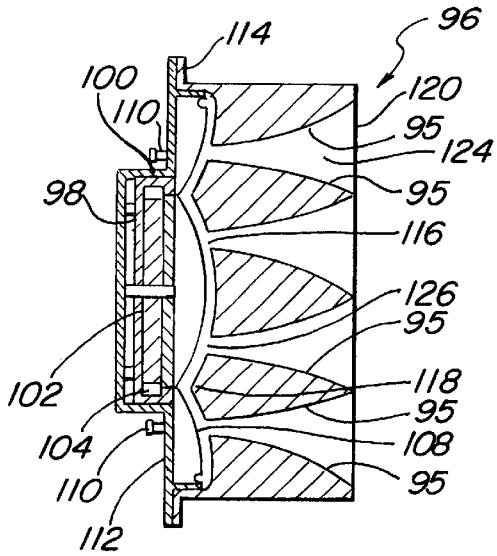
FIG. 12 is a view along line 12–12' of FIG. 11.

FIGS. 11 and 12 show a second preferred compression driver 96 containing a second preferred plug 95 suitable for use with horns or waveguides in mid-frequency range applications. FIG. 11 shows the back of the driver 96. FIG. 12 is a cross-section of the driver 96, taken along lines 12–12 in FIG. 11.

The second preferred driver 96 comprises, in addition to the plug 95, a diaphragm 108, a voice coil (not numbered), an annular magnet 98, and associated pole pieces 100, 102, and a cover (not numbered).

The plug 95 generally comprises a body (not numbered) with an input end 118 and an output end 120. As with the first embodiment, the input end may be regarded as an input surface 118 of area $A_{in}$, and the output end may be regarded as an output region 120 of lesser area $A_{out}$.

As best shown in FIG. 12, the diaphragm 108 has an annular skirt 114 and a domed center section 116. The center section 116 is shown as convex, but it may be concave. The circular magnet 98 is in contact with the inner and outer pole pieces 102, 104 and those pole pieces form an annular air gap 104. The diaphragm's voice coil extends into that gap 104 and electrical leads from the coil extend to terminals 110 on the frame 112 of the driver 96 for suitable connection to an amplifier.

The contour of the diaphragm 108 conforms to the plug's input surface 118. The plug 95 includes a plurality of input apertures 126 on its input surface 118, the input apertures 126 opening to a corresponding plurality of passages 124 that expand to a plurality of output apertures 120 in an output region 128. The output region 128, in turn, serves as the driver's throat as previously described with reference to the driver 10 shown in FIGS. 5–8.

Figure 13:
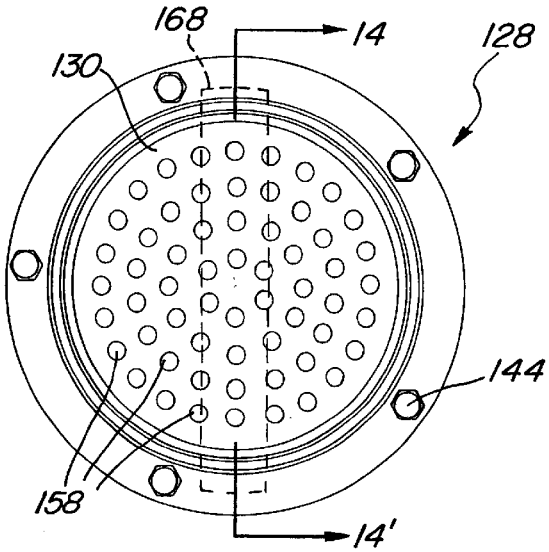
FIG. 13 is a plan view of third compression driver (without diaphragm or cover for clarity) of which the spherical input surface of a third preferred phasing/compression plug has a concave curvature visible in the center.
Figure 14:
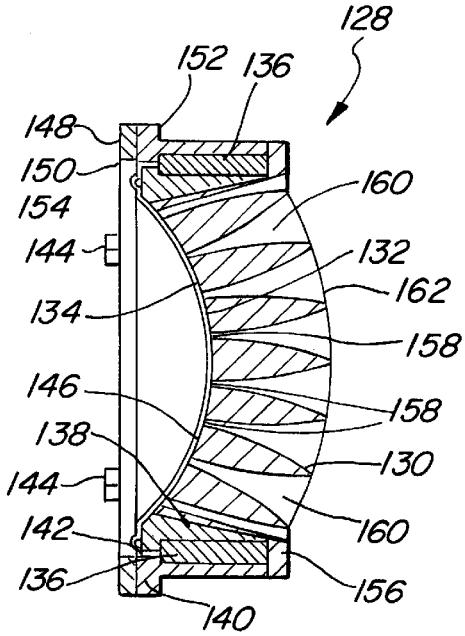
FIG. 14 is a view along line 14–14' of FIG. 13.
Figure 15:
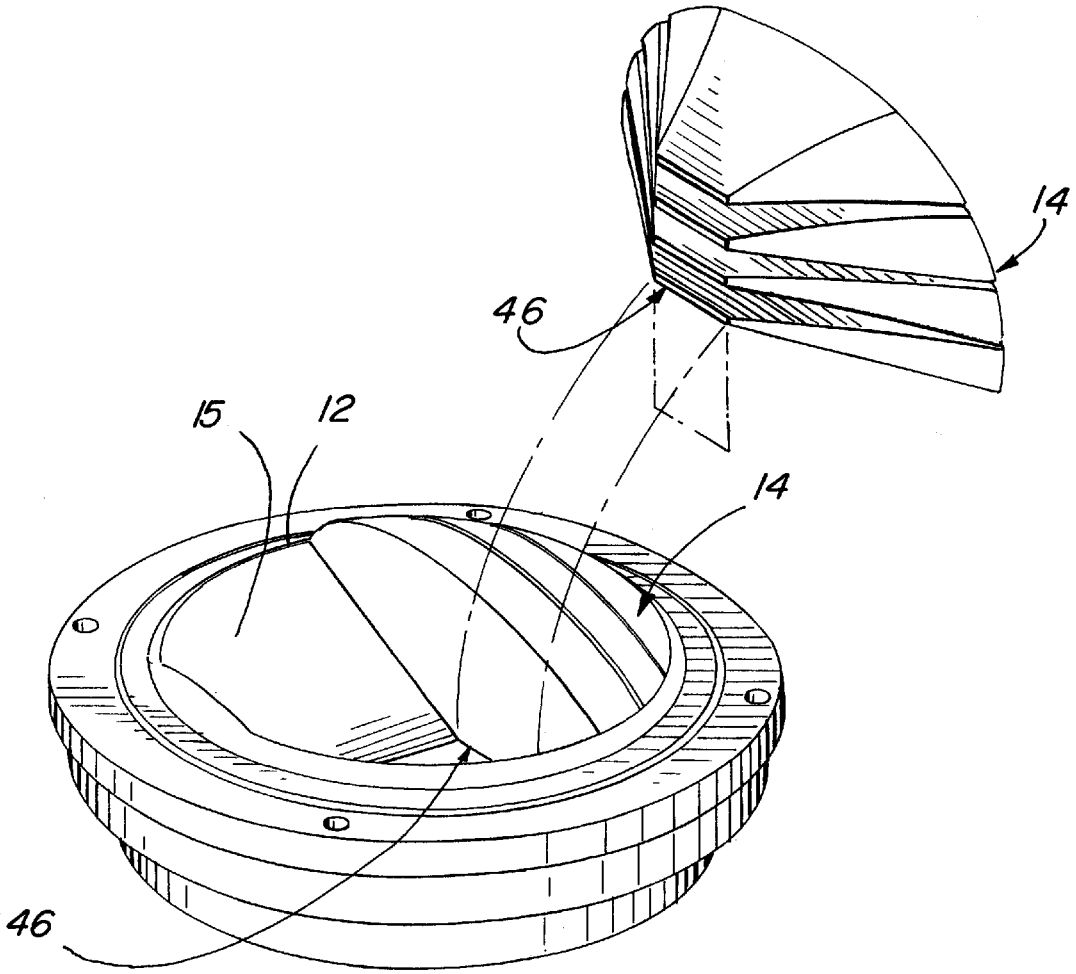
FIG. 15 is a view of the driver shown in FIGS. 5–8 with a portion of the phasing/compression plug removed to show the recess 15 which receives said plug, and with dashed lines showing input surface area $A_{in}$ and area of output region, $A_{out}$.

FIGS. 13 and 14 show a third preferred compression driver 128 containing a third plug 130 that is suitable for wide-angle applications. FIG. 13 shows the back of the driver 128. FIG. 14 is a cross-section of the driver 128, taken along lines 13–13 of FIG. 13.

The third preferred driver 128 comprises, in addition to the plug 130, a diaphragm 146, a voice coil (not numbered), a cylindrical array of magnets 136, and associated pole pieces 138, 140, and a cover (not numbered).

The plug 130 generally comprises a body (not numbered) with an input end 134 and an output end 168. As with the first two embodiments, the input end may be regarded as an input surface 134 of area $A_{in}$, and the output end may be regarded as an output region 168 of lesser area $A_{out}$.

As best shown in FIG. 14, the cylindrical array of magnets 136 are in contact with the inner and outer pole piece 138, 140 that form an annular air gap 142. The diaphragm's coil is located in that air gap. The diaphragm 146 further includes an annular compliance 154, and a periphery 148 that is secured between an annular flange 152 of the outer pole piece 140 and a ring 150 with fasteners 144 that seat in threaded bores (not shown).

The plug 130 has an annular flange 156. The plug 130 seats in a tapered recess 160 with its annular flange 156 in contact with the inner pole piece 138. The plug's input surface includes input apertures 158 that lead to passages 160 that open to output apertures 162 contained in the output region 168.

The third preferred plug 130 is suitable for wide-angle applications in that it has a concave input surface 134 that produces a convex or divergent wavefront along the major axis of the output region 168.

The invention has been described with reference to the illustrated and presently preferred embodiments. It is not intended that the invention be unduly limited by this disclosure of the preferred embodiments. Instead, it is intended that the invention be defined by the means, and their obvious equivalents, set forth in the following claims.

I claim:

1. A phasing and compression plug for use in or with an electro-acoustic transducer, the plug comprising:

a body with an input end having an input surface of area $A_{in}$ and an output end having an output region of area $A_{out}$ where $A_{in}>A_{out}$;

a plurality of input apertures provided as chordal slits that are arranged in a substantially parallel, spaced-apart configuration on the input surface at the input end of the body:

a corresponding plurality of output apertures contained in the output region at the output end of the body; and a plurality of passages through the body, each passage connecting one the plurality of input apertures with a corresponding output apertures, and expanding in area from the input apertures to the output apertures.

2. The phasing and compression plug of claim 1 wherein the output region has a non-unity aspect ratio.

3. The phasing and compression plug of claim 2 wherein a major axis of the output region is substantially perpendicular to the chordal slits.

4. The phasing and compression plug of claim 2 wherein the output apertures contained in the output region are of lesser width and greater height than said slits.

5. The phasing and compression plug of claim 2 wherein a major axis of the output region is substantially parallel to the chordal slits.

6. The phasing and compression plug of claim 5 wherein the output apertures contained in the output region are of greater width and lesser height than longest of said slits.

7. The phasing and compression plug of claim 1 in combination with a diaphragm shaped to conform to the input surface of said body.

8. A compression driver comprising the combination of phasing and compression plug and diaphragm of claim 7 in further combination with a permanent magnet between inner and outer pole pieces which are separated by a gap, and a coil integral with said diaphragm and received in said gap, the compression driver having a throat continuing from the output region of the phasing and compression plug.

9. An assembly of the compression driver of claim 8 in combination with an acoustic waveguide having a throat and a mouth, the throat of the acoustic waveguide conforming to the throat of the compression driver, the throat of the acoustic waveguide received against, aligned with, and acoustically coupled to the throat of the compression driver.

10. The assembly of claim 9 wherein the throat of the compression driver is configured as a diffraction slot.

11. The assembly of claim 10 wherein the throat of the acoustic waveguide is configured as a diffraction slot received against and aligned with the throat of the compression driver.

12. The assembly of claim 11 wherein said acoustic waveguide has a rectangular cross-section throughout its length.

13. The assembly of claim 9 wherein the distances from the diaphragm through each of said input apertures, through each respective passage, through each respective output aperture, through the throat of the compression driver, through the throat of the acoustic waveguide, and to the mouth of the acoustic waveguide are substantially equal, thereby providing a straight acoustic wavefront along an axis of said mouth.

14. The phasing and compression plug of claim 1 wherein the output apertures are of lesser width and greater height than the longest chordal slit.

15. A phasing and compression plug for use in or with an electro-acoustic transducer, the plug comprising:

a body with an input end having an input surface of area $A_{in}$ and an output end having an output region of area $A_{out}$ where $A_{in}>A_{out}$, the output region having an non-unity aspect ratio;

a plurality of input apertures on the input surface at the input end of the body:

a corresponding plurality of output apertures contained in the output region at the output end of the body;

a plurality of passages through the body, each passage connecting each of the plurality of input apertures with a corresponding output aperture, and expanding in area from the input apertures to the output apertures.

16. The plug of claim 15 wherein the output region is rectangular.

17. The plug of claim 15 wherein the output region is dimensioned to function as a diffraction slot.

18. The plug of claim 15 wherein the plurality of input apertures on the input surface at the input end of the body are provided as chordal slits that are arranged in a substantially parallel, spaced-apart configuration on the input surface at the input end of the body.

19. The plug of claim 18 wherein the chordal slits are substantially perpendicular to a major axis of the output region.

20. The plug of claim 18 wherein the chordal slits are substantially parallel to a major axis of the output region.

21. The phasing and compression plug of claim 15 wherein said input apertures are radial slits.

22. The phasing and compression plug of claim 15 wherein said input apertures are distributed holes.

23. The phasing and compression plug of claim 15 wherein said input apertures are slits that are parallel to the minor axis of said output region.

24. The phasing and compression plug of claim 15 wherein said input apertures are slits that are parallel to the major axis of said output region.

25. A phasing and compression plug for use in an electro-acoustic transducer having a diaphragm with a circular, contoured, vibrating surface, the plug having:

an input end with an input surface of area $A_{in}$ that conforms to the contour of said vibrating surface;

an output end with a output region of area $A_{out}$ where $A_{in}>A_{out}$, the output region having an non-unity aspect ratio with a major axis and a minor axis;

a plurality of input apertures provided as chordal slits that are arranged in a substantially parallel, spaced-apart configuration on the input surface of said input end;

a corresponding plurality of output apertures collectively contained in the output region at the output end of said plug; and a plurality of passages, one each extending from each of said input apertures on said input surface to a respective outlet aperture and expanding in area in the direction towards said outlet apertures.

26. The phasing and compression plug of claim 25 wherein said minor axis is no greater than 33 percent of the diameter of said circular vibrating surface.

27. The phasing and compression plug of claim 25 wherein said minor axis is no greater than 25 percent of the diameter of said circular vibrating surface.

28. The phasing and compression plug in combination with a waveguide of claim 27 wherein the distances from each of said input apertures through its respective passage to the mouth of said horn and along the axis parallel to the major axis of said slot are substantially equal to provide a straight acoustic wavefront across the corresponding axis of the mouth of the coupled waveguide.

29. The phasing and compression plug of claim 25 wherein said major axis is no less than 75 percent of the diameter of said circular vibrating surface.

30. The phasing and compression plug of claim 25 in combination with a coupled horn or waveguide having a throat of matching shape to said slot aperture and aligned therewith.

31. A compression driver having a phasing and compression plug with a plurality of input apertures at an input end having an input surface of area $A_{in}$ and with multiple passages leading to multiple output apertures at an output end and within an output region of non-unity aspect ratio and of area $A_{out}$ where $A_{in}>A_{out}$, the compression driver having a throat continuing from the output region of the phasing and compression plug, and including means to mount said compression driver to a waveguide having a matching throat.

* * * * *